US005644095A

United States Patent [19]

Davidson

[11] Patent Number: 5,644,095

[45] Date of Patent: Jul. 1, 1997

[54] BRASS INSTRUMENT IMPROVEMENT

[76] Inventor: John R. Davidson, 6565 Deering, Garden City, Mich. 48135

[21] Appl. No.: 417,513

[22] Filed: Apr. 3, 1995

Related U.S. Application Data

[63] Continuation-in-part of Ser. No. 185,590, Jan. 21, 1994, abandoned.

[51] Int. Cl.[6] ..... G10D 7/10

[52] U.S. Cl. ..... 84/453; 84/387 R; 84/395; 84/400

[58] Field of Search ..... 84/453, 387 R, 84/400, 395, 388

[56] References Cited

U.S. PATENT DOCUMENTS

| | | | |
|---|---|---|---|
| 2,470,597 | 5/1949 | Woodward | 84/400 |
| 3,529,505 | 9/1970 | Brooks | 84/387 R |

*Primary Examiner*—Cassandra C. Spyrou
*Attorney, Agent, or Firm*—John R. Benefiel

[57] ABSTRACT

An improvement to the tone and responsiveness of brass instruments is achieved by holding preshaped pieces of damping material, preferably a waxy, hot-melt adhesive, pressed against surfaces of the instrument tubing sections such as valve casings and tubing sections at particular locations, to reduce sympathetic vibrations of the instrument structure.

9 Claims, 3 Drawing Sheets

BRASS INSTRUMENT IMPROVEMENT

CROSS REFERENCE TO RELATED APPLICATION

This is a continuation-in-part of application Ser. No. 08/185,590, filed on Jan. 21, 1994, now abandoned.

BACKGROUND OF THE INVENTION

1. Field of the Invention

This invention concerns musical instruments and more particularly wind instruments of the type using a cup mouthpiece and convoluted, generally cylindrical or slightly tapering tubing terminating in a flared end or "bell." This type of instrument is commonly referred to as a "brass" instrument even though often constructed of other bright metals such as silver, nickel, etc.

2. Description of the State of the Art

In brass instruments, resonance of the air column occurs at various pitches of sounds produced by the musician's lips at the mouthpiece. Resonance is caused by the bell of the instrument. Resonance assists the musician in obtaining the tone he desires and also acts to amplify the sound the musician's lips generate at the mouthpiece. The pitches at which resonances will occur depend on the length of the tube defining the "air column" or the path along which the sound travels through the instrument. The tubing length is sufficiently long as to require forming the tubing in loops, as is done in the trumpet, French horn, tuba, and other brass instruments.

In addition, three valves are used to allow the musician to selectively vary the length of the tubing in order to enable resonances to be achieved for each note of a complete musical scale. Each valve is received in one of a bank of valve casings located along the length of the main tubing. The valves allow one of respective U-shaped slide tubes of different lengths to be placed in communication with the tubing defining the air column of the instrument, to in effect vary the length of the air column, shifting the pitches at which resonances will occur.

Resonance necessarily involves a reflection of sound at the bell back into the instrument, but reflection at other points in the bore of the tube is known to cause degeneration of tone. These unwanted reflections may be caused by irregularities along the tube.

Brass instruments act as "coupling" devices which amplify the tones produced by the musician's lips, and this amplification is at its greatest efficiency at the resonant frequencies. Coupling efficiency affects instrument responsiveness (the ease in which the instrument produces a desired tone in response to the efforts of the musician).

It has heretofore been recognized that factors which reduce coupling efficiencies include the incidence of "sympathetic" vibrations, i.e., mechanical vibration of the instrument parts.

It is the object of the present invention to improve the responsiveness and tone of cup mouthpiece or "brass" instruments by minimizing sympathetic vibrations.

SUMMARY OF THE INVENTION

The present inventor has discovered that the tone and responsiveness of brass instruments can be greatly improved by providing localized damping at particular effective locations along tubing defining the instrument air column by pressing solid pieces of readily compressible damping material against the exterior surface of the tubing at that location. Each damping piece is preferably preshaped with a concave surface, which concave surface is held pressed against an external convex surface of the instrument tubing at the particular location selected for particular effectiveness. In locations at which intervening spaces are defined between juxtaposed opposing sections of the instrument tubing, such as lead pipe, valve casings, slides, bells, etc., the damping piece may be shaped with a pair of oppositely facing concave surfaces, and installation is accomplished by wedging the piece into the intervening space so that each concave surface is held pressed against the external opposed tubing surfaces.

Alternatively, rings of damping material can be installed around accessible tubular shaped portions of the instrument, particularly at the mouthpiece receiver and the mouthpiece itself.

The readily compressible damping material is preferably a waxy, moldable material such as hot melt adhesive solid pieces.

The damping pieces may also be elastomeric, such as neoprene rubber, but this has not been found to be as effective as the waxy material.

The pressing force is preferably limited to moderate force levels to avoid the tendency to deform and misalign the tubing of the instrument, particularly for the mating sections of the slides.

The exact locations whereat the damping pieces are installed are determined empirically for the particular instrument. However, in general, for the more common brass instruments, these locations include the spaces between adjacent valve casings and between the U-shaped slide tubes at points close to the valve casings, as well as close to the slide "crooks." The rings are installed around the mouthpiece and lead pipe mouthpiece receiver section.

As examples of other locations, the lead pipe and bell sections extend across the valve casings in a number of instruments such as the piccolo trumpet, the E flat trumpet, french horn, etc. and the wedging of damping-bracing pieces between the lead pipe and bell and the valve casings has also been found to be effective in those instruments.

The responsiveness and tone of the instrument has been discovered to be dramatically improved by this treatment, which can be implemented at low cost and with minimal effort. This is believed to result from a particularly effective suppression of sympathetic vibrations in the instrument.

DETAILED DESCRIPTION

In the following detailed description, particular embodiments will be described in accordance with the requirements of 35 USC 112, and specific terminology employed for the sake of clarity, but it is to be understood that the same is not intended to be limiting and should not be so construed inasmuch as the invention is capable of taking many forms and variations within the scope of the appended claims.

Figure 1:
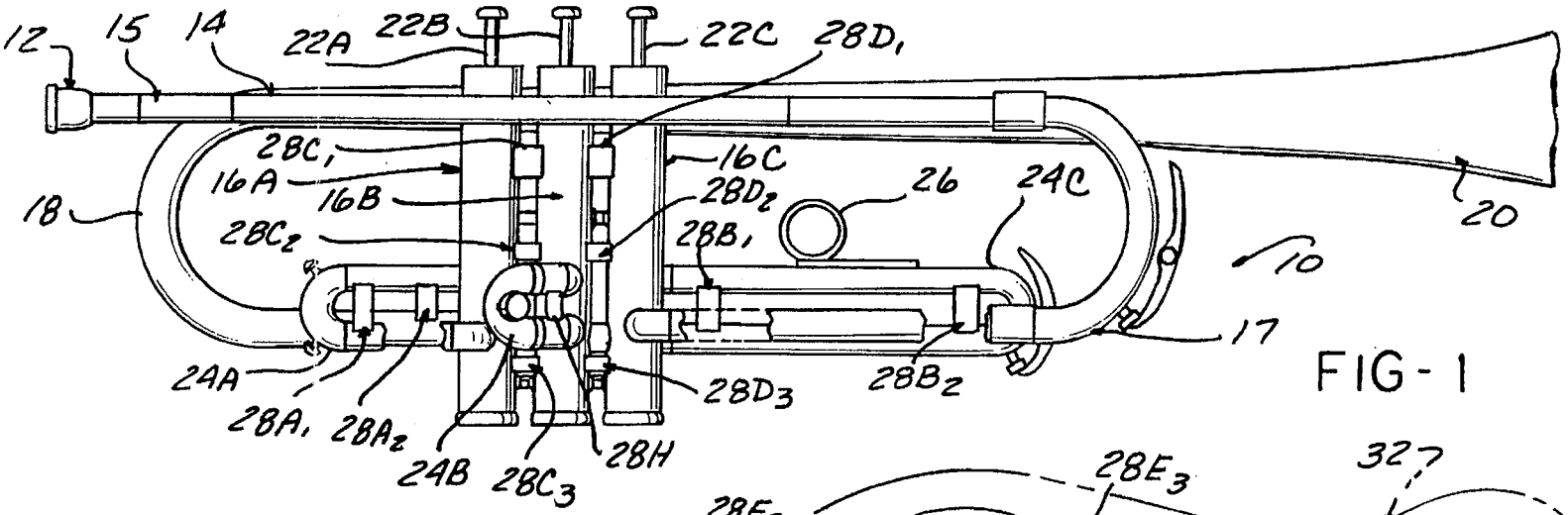
FIG. 1 is a side view of a trumpet having damping-bracing pieces installed thereon in accordance with the treatment of the present invention.

Referring to the drawings, FIG. 1 depicts a trumpet 10, a typical cup mouth piece or "brass" instrument, with which the present invention is concerned.

A cup mouthpiece 12 is installed into a mouthpiece receiver 15 at one end of tubing usually referred to as the "lead pipe" 14, which extends via a main slide 17 to a bank of valve casings 16A, 16B, 16C also included in the instrument tubing. An exit or "bell" section 18 leads to the flared end 20 at the terminal end, in conventional fashion.

Each valve casing 16A–16C houses a finger operated valve mechanism 22A–22C which can selectively place an extra U-shaped slide 24A, 24B or 24C in series communication between the entrance lead pipe 14 and exit bell section 18 to effectively lengthen the tube and shift the pitches at which resonances will occur.

The U-shaped valve slides 24A–C and main slide 17 are comprised of slidably fit sections, adjustably positioned as with an attached ring 26, enabling a musician to tune by flattening a note produced at a resonance point, in the manner well known to those skilled in the art.

According to the concept of the present invention, various sections of the various segments of the instrument structure, i.e., the mouthpiece 12, the mouthpiece receiver 15, lead pipe 14, main slide 17, the valve slides 24, the valve casings 16, and bell 18, are treated by holding solid pieces 28 of concavely preshaped damping material pressed against convex surfaces of the instrument tubing at particular locations.

In the case of opposing surfaces, this is done by wedging, with moderate pressure, damping pieces 28 having oppositely facing concave surfaces engaging opposing convex surfaces of the juxtaposed instrument structure.

The selection of the particular locations whereat damping pieces 28 are installed is important in achieving the desired results, and the locations and exact positions at those locations must be determined empirically for each individual instrument.

In general, however, wedging of pieces 28 $C_1$, 28 $C_2$, 28 $C_3$, 28 $D_1$, 28 $D_2$, 28 $D_3$ at spaced locations along adjacent valve casings 16A–16C, as on trumpets or cornets for example, at the top, middle and bottom of the spaces between adjacent casing has been found to be particularly effective.

Also, the U-shaped valve slides 24A–24C projecting from each valve casing 16A–16C should have damping pieces 28 $A_1$, $A_2$, 28 $B_1$, $B_2$ wedged between the arms of the slide 24A at a point closely adjacent its supporting casing, as well as adjacent the crook.

Even the shortest slide 24B may be provided with one or more damping pieces 28H.

Figure 1A:
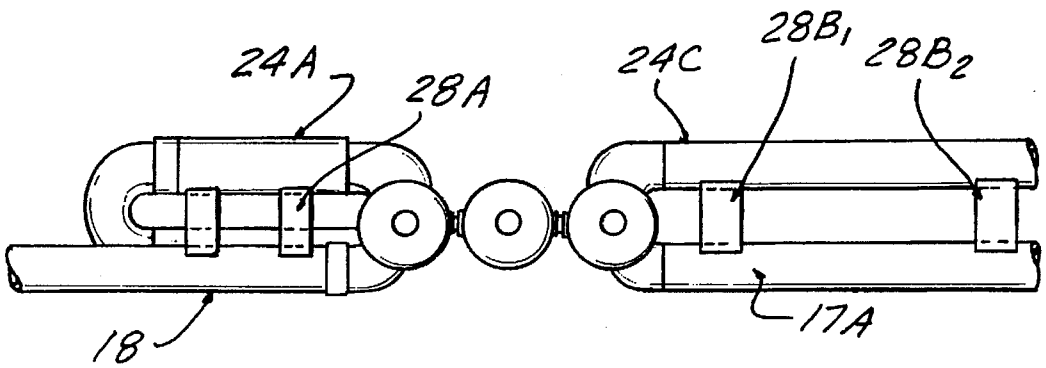
FIG. 1A is a fragmentary bottom view of the trumpet shown in FIG. 1 showing additional locations whereat the damping-bracing pieces may be installed.

Alternatively, it may produce even better results to wedge the damping pieces 28 $A_1$, $A_2$, 28 $B_1$, $B_2$ between one arm of the U-shaped tuning slides 24A, 24C and an opposing portion of the bell section 18 or the lower segment 17A of the main slide 17 as shown in FIG. 1A.

Again, the optimal general location and exact position at that location must be determined by experiment for each instrument.

The damping pieces 28 should be sized so as to produce moderate pressure, producing at least a minimal pressure, but not exerting excessive force tending to misalign the tubing. This is important where tuning slides are fit together, as excessive pressure will produce misaligning of the mating sections. The pieces 28 should be able to be moved with only moderate, manually applied pressure when properly fit.

The damping pieces 28 are preferably constructed of a waxy, readily moldable material. Solid pieces of hot melt adhesive have been discovered to be best for this purpose. Specifically, 3M "JET MELT" 3764 containing a paraffin wax has been successfully used. According to published data, this material is composed of ethylenevinyl acetate polymer (50–60%), hydrocarbon resin (20–30%), polyethylene (1–10%), paraffin wax (1–10%), antioxidant (1–10%), and vinyl acetate (0.1–1%).

The material is preshaped into an hourglass shape, having oppositely facing concave surfaces, or the ring shapes having an internally curved surface sized to be press fitted to tubular segments of the instrument structure. By softening the pieces in hot water, installation is easily accomplished.

This material can be held firmly pressed against the instrument surfaces without creating excessive distorting stress on the tubing sections. The waxiness of the material creates a very effective dampening effect when so installed.

Figure 6:
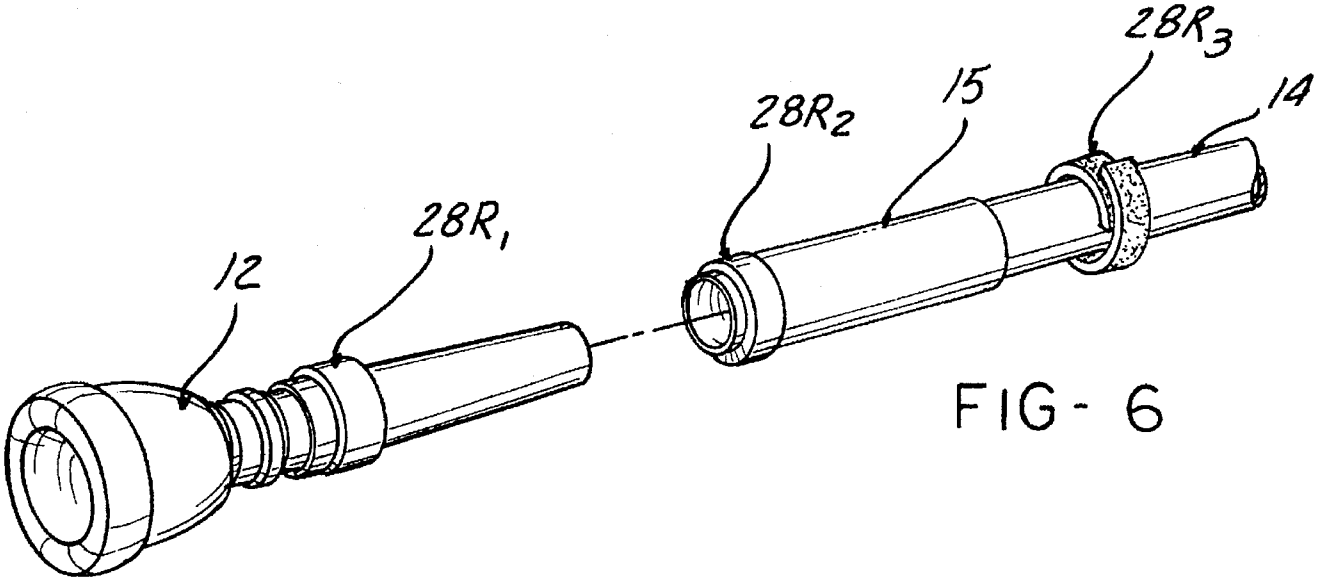
FIG. 6 is an exploded perspective view of the lead pipe portion of a brass instrument and a mouthpiece, having ring shaped damping pieces installed thereon.

In addition to opposed surface installations, a first ring of damping material 28$R_1$ is pressed on the tapered section of the mouthpiece 12 and a second ring 28$R_2$ is pressed on the mouthpiece receiver 15 (FIG. 6).

The pieces may also be constructed of a readily compressible elastomeric, although this has been found to be less effective than the hot melt adhesive material described.

Neoprene is the preferred elastomeric material, as it does not contain sulfur, which can attack the finish of brass, but other suitable compressible materials could be employed.

A durometer of A 40 has been found effective, but A 60 has also been found to work.

Figure 4:
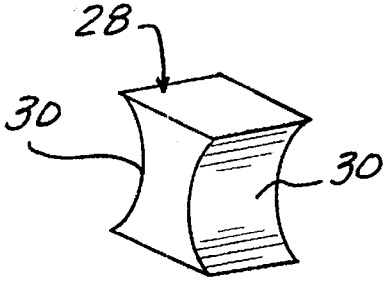
FIG. 4 is an enlarged perspective view of a damping-bracing piece used in the instrument treatment according to the present invention.

As seen in FIG. 4, the damping pieces 28 are preferably preshaped with oppositely facing concave end surfaces 30 on opposite ends which portions will fit against the outside of the tubing, valve casings, and other convex surfaces of the instrument structure to be coupled thereto to effectively apply dampening forces to the instrument.

Figure 2:
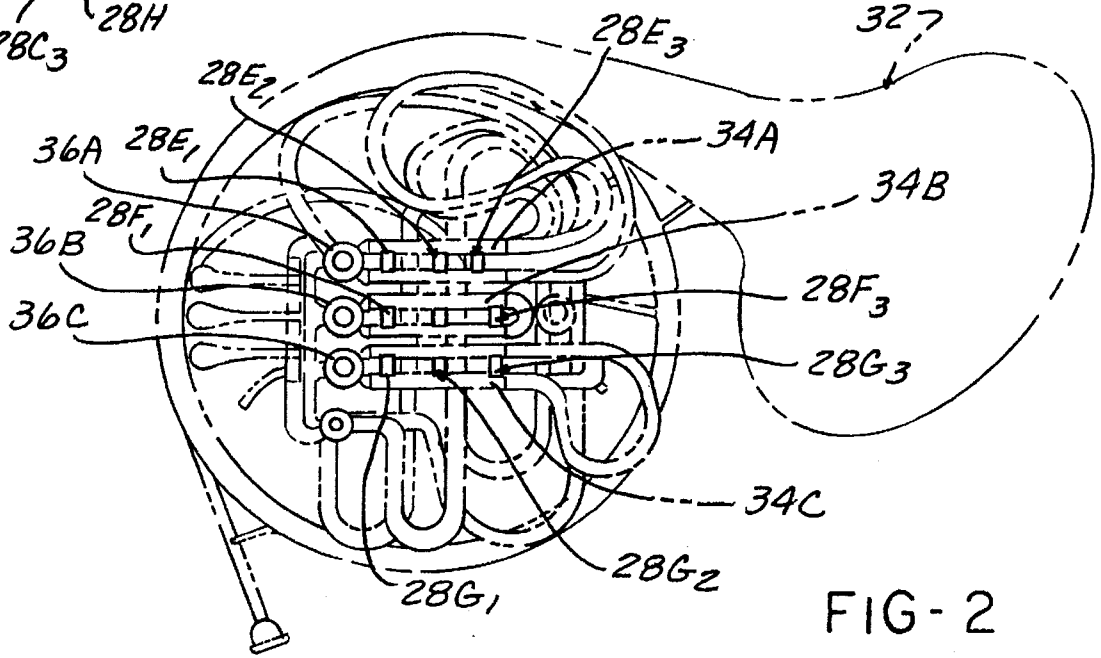
FIG. 2 is a side view of a French horn showing installation of damping-bracing pieces between the opposite arms of the tuning slides in the instrument treatment according to the present invention.

This treatment has been found very effective to improve the responsiveness and tone of brass instruments of various types, such as the French horn 32 shown in FIG. 2. In this case, a series of pieces 28 $E_1$, 28 $E_2$, 28 $E_3$, 28 $F_1$, 28 $F_2$, 28 $F_3$, 28 $G_1$, 28 $G_2$, 28 $G_3$ are fit between opposing sides of the U-shaped slides 34 A–C projecting from rotary valve casings 36 A–C. Additional pieces 28 at other locations will also provide further improvement.

Figure 3:
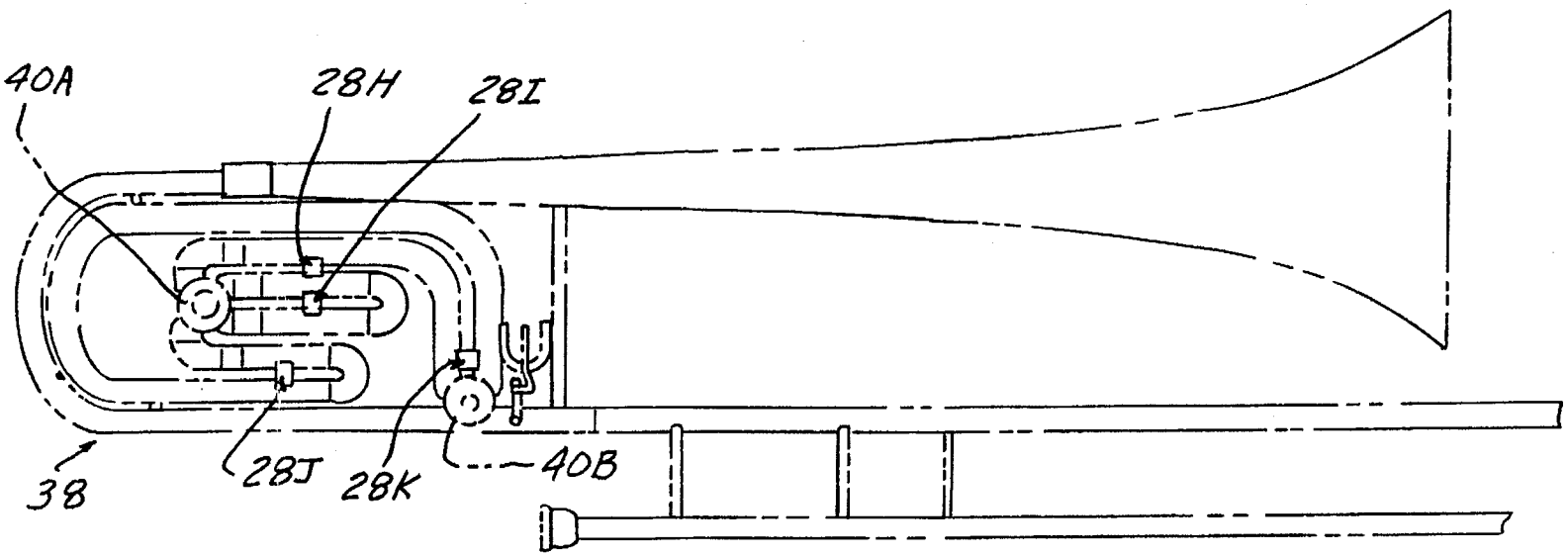
FIG. 3 is a side view of a rotary valved slide trombone, showing installation of wedged damping-bracing pieces between arms of the tuning slide according to the instrument treatment of the present invention.

This treatment has also been successfully used with trombones (FIG. 3) 38 having rotary valves 40A, 40B. The damping pieces 28 H–K are wedged between opposing juxtaposed tubing sections in similar fashion.

For some instruments, i.e., the piccolo trumpet and the E flat trumpet for example, the lead pipe and bell extend across other parts of the instrument to define a gap into which the compressible damping pieces can be wedged.

It is believed that the pieces 28 inserted in the proper locations improve the responsiveness and tone of cup mouthpiece or brass instruments by quite effectively eliminating sympathetic vibrations which are particularly prone to occur as where there are cantilevered tubing sections, as is the situation for valve casings and slides projecting from the valve casings, as well as the mouthpiece and mouthpiece receiver.

Figure 5:
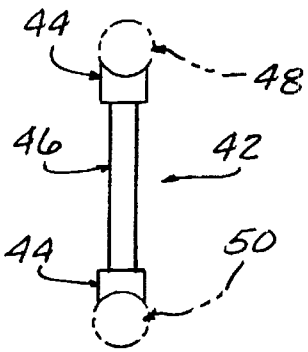
FIG. 5 is a diagrammatic representation of an alternative form of the damping piece shown installed between opposing tubing segments.

FIG. 5 illustrates that a different configuration damping piece 42 can be employed for installation in relatively large gaps. Preshaped bits of the compressible damping material 44 can be mounted on either end of a rigid rod 46, with each bit fit against an opposing surface of instrument tubing sections 48, 50, thus exerting an adequate pressing engagement despite the large size of the gap.

Figure 7:
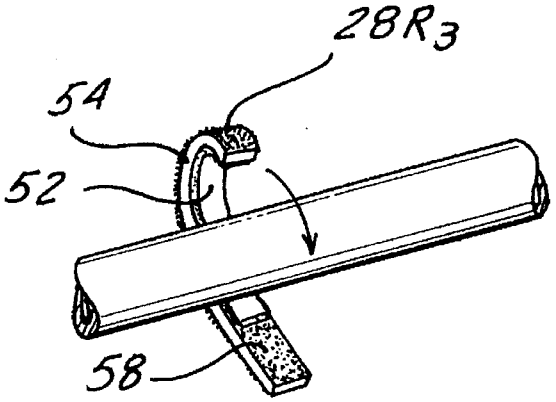
FIG. 7 is a perspective view of an encircling strap damping piece in position to be wrapped on a tubing section of brass instrument.

FIG. 7 shows a ring piece $28R_3$ which has an open ring 52 of damping material adhered to a strap 54 formed with a Velcro™ surface 56 on the outside and a mating Velcro™ surface 58 on a portion of the inside. This allows the ring 52 to be held pressed against the outside of a tubing section by wrapping of the strap 54 and securement of the Velcro™ surfaces 54,58 as shown in FIG. 7.

I claim:

1. A method of treating a cup mouthpiece wind instrument having an integral series of metal tubing sections with external convexly curved surfaces, said sections having internal spaces defining an air column, said method comprising a treatment for improving the tone and responsiveness of the instrument by the steps of:

preshaping a damping piece of readily moldable waxy material with a concavely shaped surface portion;

holding said piece of readily moldable waxy material with the concavely shaped surface portion pressed against one of said external convexly curved surfaces of said integral series of metal tubing sections at an effective location to attenuate sympathetic vibrations.

2. The method according to claim 1 wherein the external convexly curved surfaces of the tubing sections further includes opposing portions defining an intervening space therebetween, wherein the step of preshaping further includes preshaping the concavely shaded surface portion of the damping piece with two oppositely facing concave surfaces and the step of holding said piece pressed against the one of said external convexly curved surfaces of said tubing sections includes the step of wedging said piece between said opposing portions, whereby both of said oppositely facing concave surfaces are pressed against the opposing portions of the tubing surface.

3. The method according to claim 2 wherein said preshaping step includes the step of forming said damping piece from a hot melt adhesive.

4. The method according to claim 1 wherein said instrument has Juxtaposed tubing sections including a plurality of side by side valve casings, each valve casing having an attached U-shaped tuning slide, each tuning slide comprised of a pair of tubing slide arms projecting from a respective valve casing, and wherein said holding step includes the step of press fitting said damping piece between two of said side-by-side valve casings.

5. The method according to claim 4 further including the step of preshaping an additional damping piece and wedging said additional damping piece between said arms of one of said tuning slides at a location adjacent one of said valve casings from which said arms of said one U-shaped tuning slide projects.

6. The method according to claim 5 further including the step of preshaping a further additional damping piece and further including the step of wedging said further additional damping piece adjacent a crook of said tuning slide.

7. In combination with a brass instrument having a mouth piece, a series of integral, convoluted metal tubing sections, and a bell, the improvement comprising:

a damping piece of readily moldable waxy material held pressed against at least one external convex surface on said instrument tubing sections, whereby the tone and responsiveness of said instrument is improved.

8. The brass instrument according to claim 7 wherein said damping piece is preshaped with a concave surface, said concave surface pressed against said external convex surface of said instrument tubing.

9. The brass instrument according to claim 8 wherein said damping piece is composed of a solid piece of hot melt adhesive containing wax.

* * * * *